US009732961B2

(12) United States Patent
Holcomb et al.

(10) Patent No.: US 9,732,961 B2
(45) Date of Patent: Aug. 15, 2017

(54) ONLINE ESTIMATION OF SPECIFIC GRAVITY OF GAS FUEL

(71) Applicant: Solar Turbines Incorporated, San Diego, CA (US)

(72) Inventors: Chad M. Holcomb, San Diego, CA (US); Richard C. Whalen, Encinitas, CA (US); Robert Hiroshi Moroto, Los Angeles, CA (US)

(73) Assignee: Solar Turbines Incorporated, San Diego, CA (US)

( * ) Notice: Subject to any disclaimer, the term of this patent is extended or adjusted under 35 U.S.C. 154(b) by 286 days.

(21) Appl. No.: 14/701,413

(22) Filed: Apr. 30, 2015

(65) Prior Publication Data

US 2016/0320061 A1 Nov. 3, 2016

(51) Int. Cl.
*F23R 3/28* (2006.01)
*F23N 1/00* (2006.01)

(52) U.S. Cl.
CPC ..... *F23R 3/28* (2013.01); *F23N 1/002* (2013.01); *F23N 2021/10* (2013.01); *F23N 2025/06* (2013.01); *F23N 2025/20* (2013.01); *F23N 2041/20* (2013.01)

(58) Field of Classification Search
CPC .... F23R 3/28; F02C 9/26; F02C 7/232; F23N 1/002; F23N 1/005; F23N 2025/04; F23N 2025/06; F23N 2025/08; F23N 2021/10; F02D 2041/1417; F16H 2061/0078
See application file for complete search history.

(56) References Cited

U.S. PATENT DOCUMENTS

| | | | | |
|---|---|---|---|---|
| 4,581,708 | A | 4/1986 | Van Ostrand | |
| 7,277,788 | B2 | 10/2007 | Boley et al. | |
| 7,730,726 | B2 | 6/2010 | Asti et al. | |
| 2013/0233056 | A1* | 9/2013 | Ishiguro | G01N 29/024 73/30.01 |
| 2014/0018973 | A1 | 1/2014 | Drohan | |
| 2014/0238032 | A1 | 8/2014 | Fitzgerald et al. | |
| 2016/0305339 | A1* | 10/2016 | Morgan | F01D 17/08 |

FOREIGN PATENT DOCUMENTS

WO 2014086541 A1 6/2014

* cited by examiner

*Primary Examiner* — Pascal M Bui Pho
*Assistant Examiner* — Katheryn Malatek
(74) *Attorney, Agent, or Firm* — Procopio, Cory, Hargreaves & Savitch LLP

(57) ABSTRACT

A method for determining an estimate of the specific gravity of a fuel for a gas turbine engine is disclosed. The gas turbine engine includes a fuel control valve and one or more fuel injectors. The method includes determining a first estimate of the specific gravity based on an orifice flow model of the fuel control valve. The method also includes determining a second estimate of the specific gravity based on a combined orifice flow model of the one or more fuel injectors. The method further includes recursively filtering the first estimate and the second estimate to determine a third estimate of the specific gravity.

17 Claims, 3 Drawing Sheets

ONLINE ESTIMATION OF SPECIFIC GRAVITY OF GAS FUEL

TECHNICAL FIELD

The present disclosure generally pertains to gas turbine engines, and is directed toward a control system for gas turbine engines with online estimation of the specific gravity of gas fuel.

BACKGROUND

Gas turbine engines include compressor, combustor, and turbine sections. Gas turbine engines also include a fuel system that supplies fuel to the combustor and includes a control system that, inter alia, meters the fuel supply. The control system uses knowledge of several parameters that describe bulk fuel properties for various functions, such as metering, performance monitoring, and determining appropriate safety limits. Two of these parameters are the specific gravity and lower heating value of the fuel. The ratio of the lower heating value over the square root of the specific gravity is known as the Wobbe Index. The Wobbe Index serves as an equivalence measure for fuel sources.

U.S. Patent App. No. 2014/0238032 to Fitzgerald et. al. discloses a sensor apparatus and methods for facilitating combustion of a gaseous fuel. The sensor apparatus comprises a combustion apparatus defining a combustion chamber therein. The combustion apparatus is configured to combust a fuel-air mixture within the combustion chamber to produce at least one combustion product. At least one optical diagnostic apparatus is coupled to the combustion apparatus for measuring at least one property of the at least one combustion product within the combustion chamber. A controller is coupled to the at least one optical diagnostic apparatus, and is configured to determine the Wobbe index of the fuel in real-time based on the measured at least one property of the at least one combustion product and predetermined combustion state data stored within the controller.

The present disclosure is directed toward overcoming one or more of the problems discovered by the inventors or that is known in the art.

SUMMARY OF THE DISCLOSURE

A method for determining an estimate of the specific gravity of a fuel used in a gas turbine engine is disclosed. The gas turbine engine including a fuel system that includes a fuel line, a mass flow meter, a fuel control valve located on the fuel line and one or more fuel injectors connected to the fuel line downstream of the fuel control valve. In embodiments, the method includes determining a first estimate of the specific gravity of the fuel using measurements of mass flow from the mass flow meter, a first pressure of the fuel upstream of the fuel control valve, a second pressure of the fuel downstream of the fuel control valve, a first temperature of the fuel upstream of the fuel control valve, and an effective area of the fuel control valve. The method also includes determining a second estimate of the specific gravity of the fuel using the measurements of mass flow from the mass flow meter, a third pressure of the fuel upstream of the one or more fuel injectors, a fourth pressure of the fuel downstream of the one or more fuel injectors, a second temperature downstream of the fuel control valve and upstream of the one or more fuel injectors, and a combined effective area of the one or more fuel injectors.

The method further includes recursively filtering the first estimate of the specific gravity and the second estimate of the specific gravity to determine a third estimate of the specific gravity of the fuel.

A fuel system for the gas turbine engine including one or more fuel injectors and a fuel line that supplies fuel to the one or more injectors is also disclosed. In embodiments, the fuel system includes a fuel control valve on the fuel line upstream of the one or more fuel injectors, a mass flow meter in the fuel line, and an estimation module. The estimation module includes a valve module, an injector module, and a specific gravity module. The valve module is configured to determine a first estimate of the specific gravity of the fuel using measurements of mass flow from the mass flow meter, a first pressure of the fuel upstream of the fuel control valve, a second pressure of the fuel downstream of the fuel control valve and upstream of the one or more fuel injectors, a first temperature of the fuel upstream of the fuel control valve, and an effective area of the fuel control valve. The injector module is configured to determine a second estimate of the specific gravity of the fuel using the measurements of the mass flow from the mass flow meter, a third pressure of the fuel upstream of the one or more fuel injectors, a fourth pressure of the fuel downstream of the one or more fuel injectors, a second temperature downstream of the fuel control valve and upstream of the one or more fuel injectors, and a combined effective area of the one or more fuel injectors. The specific gravity module is configured to determine a third estimate of the specific gravity of the fuel from the first estimate of the specific gravity and the second estimate of the specific gravity with a recursive filter.

DETAILED DESCRIPTION

The systems and methods disclosed herein are for determining an estimate of a specific gravity of a fuel supplied to a gas turbine engine. In embodiments, a first estimate of the specific gravity is determined based on a model of the fuel control valve of the gas turbine engine using mass flow measurements from a mass flow meter and a second estimate of the specific gravity is determined based on a model of the one or more fuel injectors of the gas turbine engine using mass flow measurements from the mass flow meter. A third estimate of the specific gravity is determined using a recursive filter based on the first estimate and the second estimate. Determining an estimate of the specific gravity in this manner may be a low cost, fast, and accurate method for obtaining the specific gravity of the fuel, which may change over time. The knowledge of specific gravity may be sufficient for the control system to provide reliable and safe operation when the fuel supply composition is changing over time.

Figure 1:
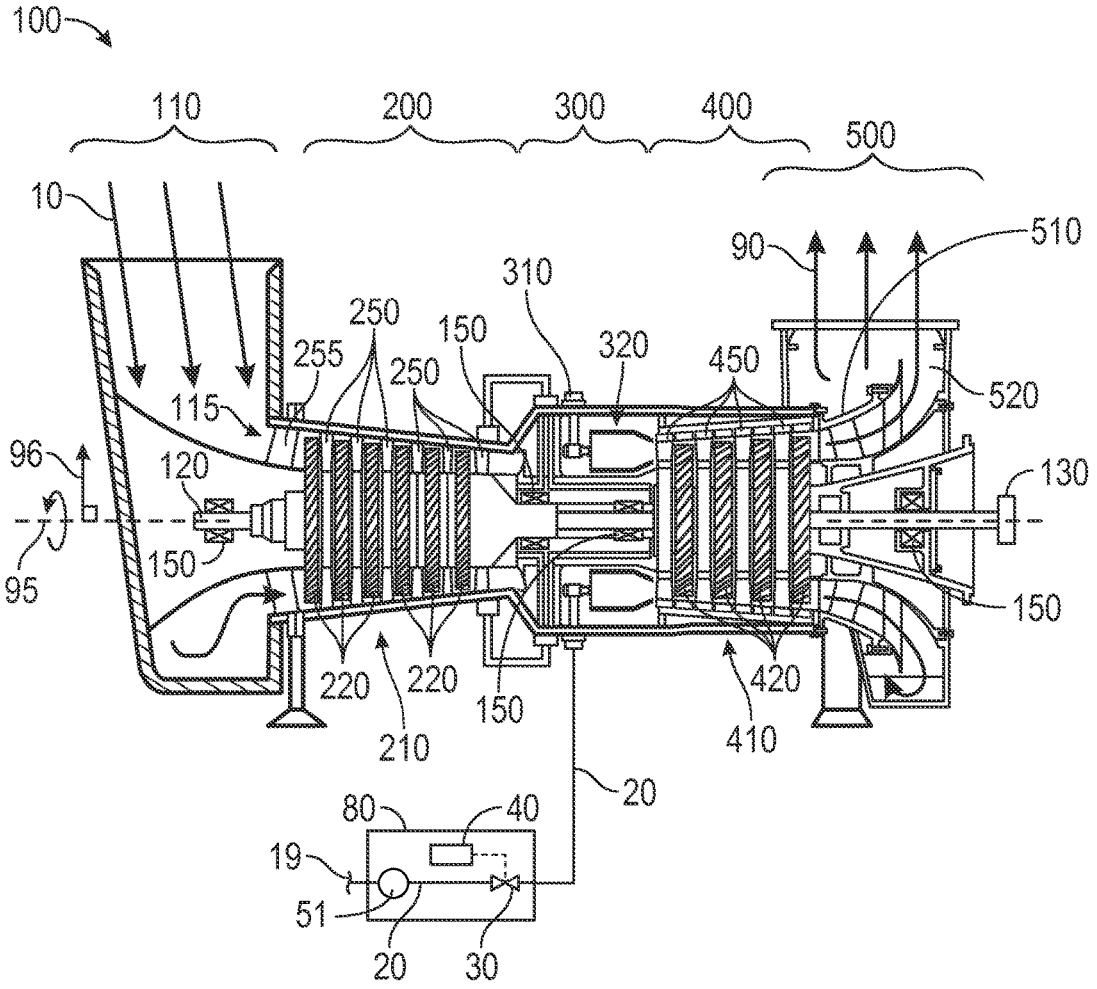
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow direction, and aft is "downstream" relative to primary air flow direction.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or compressor 200, a combustor 300, a fuel system 80, a turbine 400, an exhaust 500, and a power output coupling 130. The gas turbine engine 100 may have a single shaft or a dual shaft configuration.

The compressor 200 includes a compressor rotor assembly 210, compressor stationary vanes ("stators") 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the first compressor stage.

The combustor 300 includes one or more fuel injectors 310 and a combustion chamber 320.

The fuel system 80 supplies and controls the delivery of fuel to the one or more fuel injectors 310. Fuel system 80 generally includes a control system 40, a fuel line 20 connected to a fuel source at a connection point 19, a mass flow meter 51, and a fuel injector 310. A fuel control valve 30 is used to meter the flow of fuel through fuel line 20.

The turbine 400 includes a turbine rotor assembly 410 and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. A turbine nozzle 450, such as a nozzle ring, axially precedes each of the turbine disk assemblies 420. Each turbine nozzle 450 includes multiple methods grouped together to form a ring. Each turbine disk assembly 420 paired with the adjacent turbine nozzle 450 that precede the turbine disk assembly 420 is considered a turbine stage. Turbine 400 includes multiple turbine stages.

The exhaust 500 includes an exhaust diffuser 510 and an exhaust collector 520.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
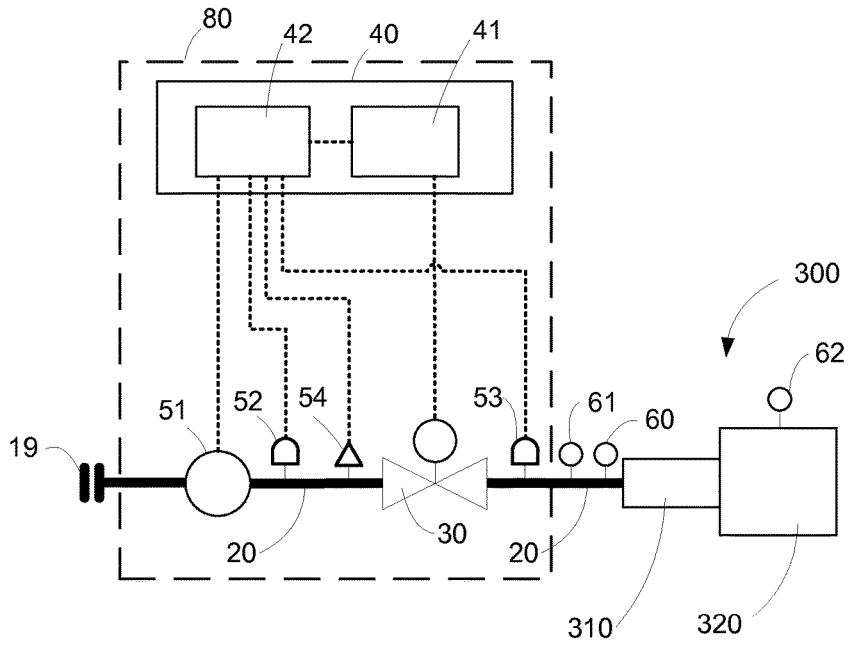
FIG. 2 is a schematic diagram of the fuel system of FIG. 1.

FIG. 2 is a schematic diagram of the fuel system 80 of FIG. 1 connected to a combustor 300 of FIG. 1. Fuel system 80 includes a number of sensors connected to fuel line 20. The sensors include a mass flow meter 51, such as a Coriolis type mass flow sensor, a first pressure sensor 52, a second pressure sensor 53, and a first temperature sensor 54. In the embodiment illustrated, mass flow meter 51 is located upstream of fuel control valve 30. In other embodiments, mass flow meter 51 is located between fuel control valve 30 and fuel injector 310. In yet further embodiments, mass flow meter 51 is located upstream of connection point 19. The mass flow meter 51 may be located along any point of fuel line 20 or along the fuel supply line from the fuel source for the gas turbine engine 100 so long as mass flow meter 51 is connected in series with fuel control valve 30.

First pressure sensor 52 is located on fuel line 20 upstream of fuel control valve 30 and may be adjacent fuel control valve 30. First pressure sensor 52 is configured to provide a first pressure of the fuel in fuel line 20 upstream of the fuel control valve 30.

Second pressure sensor 53 is located on fuel line 20 downstream of fuel control valve 30 and upstream of fuel injector 310. Second pressure sensor 53 is configured to provide a second pressure of the fuel in fuel line 20 between the fuel control valve 30 and the fuel injector 310. Second pressure sensor 53 may be configured to provide the pressure of the fuel adjacent and downstream of fuel control valve 30.

First temperature sensor 54 is located on fuel line 20 upstream of fuel control valve 30 and may also be adjacent fuel control valve 30. First temperature sensor 54 is configured to provide a first temperature of the fuel in fuel line 20 upstream of the fuel control valve 30.

In the embodiment illustrated, control system 40 includes an estimation module 42 and a control module 41. In other embodiments, the estimation module 42 may be located remotely to the gas turbine engine 100 and to the control system 40. Estimation module 42 receives the data from the various sensors and uses the data to, inter alia, determine an estimation of the specific gravity of the fuel in fuel line 20. The data received by the estimation module 42 may be received as real time data or as batch data.

Control module 41 receives data from the estimation module 42 including the estimation of the specific gravity of the fuel and uses the data to control the gas turbine engine 100 including the fuel control valve 30, such as by sending an actuation command signal to the fuel control valve 30. The data received by control module 41 may be received in real time or may be received periodically, such as after a batch of data is processed. In embodiments, the control system 40 includes a computer that includes a processor running software to implement the modules described herein, such as the estimation module 42 and the control module 41.

Figure 3:
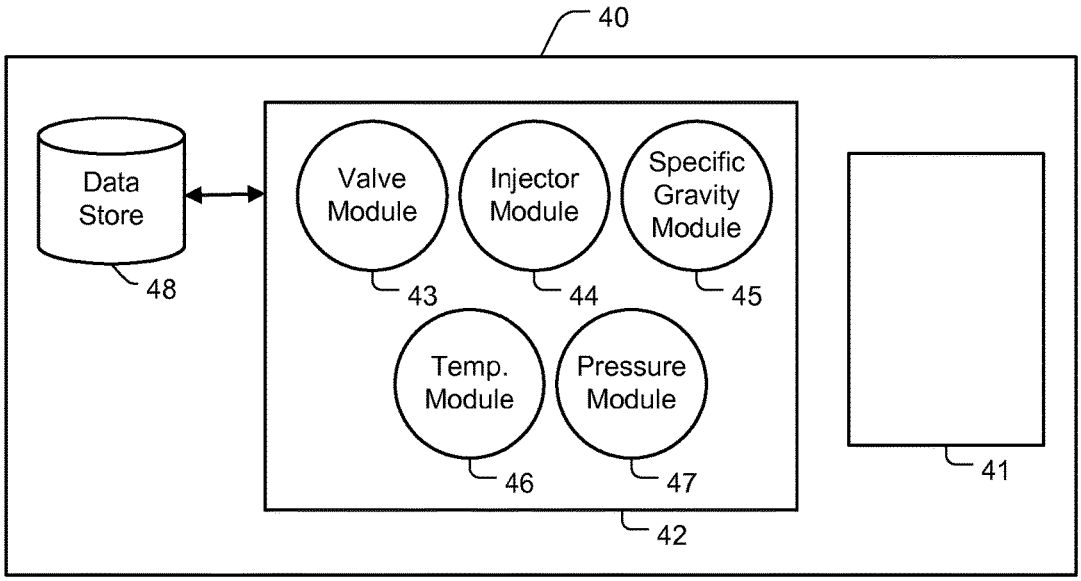
FIG. 3 is a functional block diagram of the control system of FIG. 2.

FIG. 3 is a functional block diagram of the control system 40 of FIG. 2. Referring to FIGS. 2 and 3, estimation module 42 includes a valve module 43, an injector module 44, and a specific gravity module 45. Estimation module 42 may also include a temperature module 46 and a pressure module 47. Valve module 43 determines a first estimate of the specific gravity of the fuel using an orifice model of the fuel control valve 30. Valve module 43 uses, inter alia, the data, such as measurements, obtained from mass flow meter 51, first pressure sensor 52, second pressure sensor 53, and first temperature sensor 54 to determine the first estimate.

Injector module 44 determines a second estimate of the specific gravity of the fuel using an orifice model of the fuel injector(s) 310. Referring to FIG. 2, while a single fuel injector 310 is shown, the combustor 300 may include multiple fuel injectors 310 that may be combined into a lumped orifice model. Injector module 44 uses, inter alia, the data obtained from mass flow meter 51 along with data that represents a third pressure 60, a second temperature 61, and a fourth pressure 62.

The third pressure 60 represents the pressure of the fuel located upstream of the fuel injector(s) 310 and may be the pressure of the fuel in fuel line 20 adjacent the fuel injector(s) 310. In the embodiment illustrated, the third pressure 60 is determined by the pressure module 67 from the second pressure measured downstream of the fuel control valve 30 by second pressure sensor 53. The third pressure 60 may be determined based on a correction applied to the second pressure based on empirical data or on the physical geometry of the package. In other embodiments, the second pressure is used for the third pressure. In yet other embodiments, another pressure sensor is used to measure the third pressure 60.

In the embodiment illustrated, the second temperature 61 is determined by temperature module 46. Temperature module 46 may determine the second temperature 61 using the data from first pressure sensor 52 and first temperature sensor 54 using the Joule-Thompson effect. The second temperature 61 represents the temperature of the fuel downstream of fuel control valve 30 and upstream of fuel injector(s) 310. In other embodiments, the second temperature 61 is determined using a second temperature sensor located between fuel control valve 30 and fuel injector(s) 310.

In the embodiment illustrated, the fourth pressure 62 is determined as a known fraction of the compressor discharge pressure by the pressure module 47. The compressor discharge pressure may be measured directly. In some embodiments, the compressor discharge pressure is available through direct measurement using a sensor and a flow path into the combustor, such as the flow path to the torch used for igniting the turbine on startup or a dedicated pressure port. The fixed percentage may be predetermined empirically for gas turbine engine 100. Each model of gas turbine engine 100 may have a different predetermined fixed percentage. The fourth pressure 62 represents the pressure of the combustion chamber 320 downstream of the fuel injector(s) 310. In other embodiments, a fourth pressure sensor is used to measure the pressure of the combustion chamber 320 downstream of the fuel injector(s) 310.

Specific gravity module 45 determines a third estimate of the specific gravity of the fuel in fuel line 20 using the first estimate and the second estimate of the specific gravity. The specific gravity module 45 uses a recursive algorithm that combines the first and second estimates to produce the third estimate of the specific gravity that is a higher-quality, filtered estimate of the specific gravity. The recursive algorithm may be a filter with an internal dynamic model that describes the time evolution and relation of past estimates and estimation errors to the next estimate and estimation error. The third estimate of the specific gravity may be used to control the gas turbine engine 100 with the control module 41 and may be used with other processes, such as safety, operations, and diagnostic functions.

Control system 40 may also include a data store 48. The data store 48 may store fuel data, preselected inputs, and the internal dynamic model over a defined period of time.

Industrial Applicability

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. The amount of fuel added is controlled by control system 40 and depends on the composition of the fuel. Air 10 and fuel are injected into the combustion chamber 320 via fuel injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

The control system 40 generally relies on knowledge of the lower heating value, the specific gravity, and the ratio of specific heats to ensure safe and stable fuel control. The lower heating value and specific gravity can be characterized using the Wobbe Index. The Wobbe Index is generally defined as:

$$WI = \frac{LHV}{\sqrt{SG}}$$

where WI is the Wobbe Index, LHV is the lower heating value, and SG is the specific gravity of the fuel.

A sufficiently accurate estimate of the specific gravity of the fuel may serve as a sufficient and cost effective surrogate measurement for determining the bulk fuel properties for controlling the gas turbine engine 100, for monitoring the gas turbine engine 100, for gas turbine engine diagnostics, and for other safety and monitoring functions, especially in locations where the specific gravity of the fuel varies, such as at waste disposal facilities.

Figure 4:
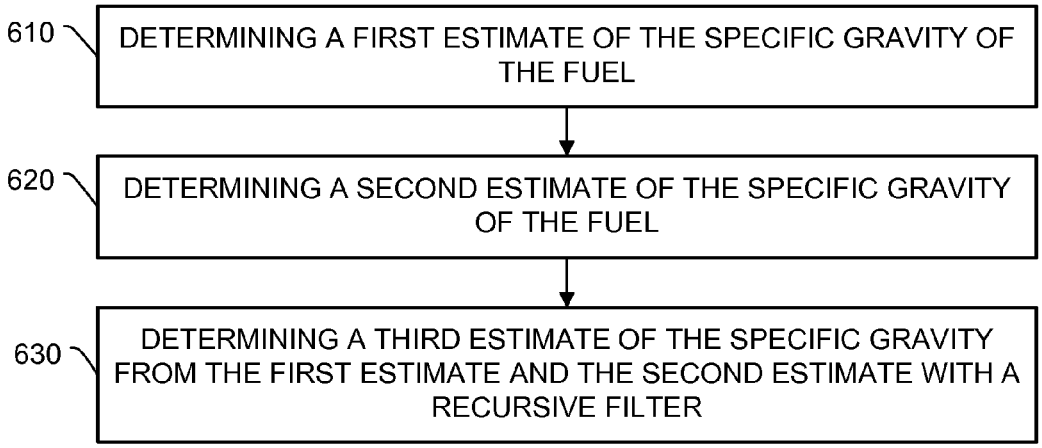
FIG. 4 is a flowchart of a method for estimating the specific gravity of a gas fuel for the gas turbine engine of FIG. 1.

FIG. 4 is a flowchart of a method for estimating the specific gravity of a gas fuel for the gas turbine engine of FIG. 1. The method includes determining a first estimate of the specific gravity of the fuel at step 610. The first estimate of the specific gravity may be determined by the valve module 43. Step 610 may use an orifice flow model of the fuel control valve 30 modeled as adiabatic compressible flow of an ideal gas through a sharp-edged orifice with a known area. The method also includes determining a second estimate of the specific gravity of the fuel at step 620. The second estimate of the specific gravity may be determined by the injector module 44. Step 620 may use a combined orifice flow model that geometrically describes the fuel injector(s) 310 by a single effective flow area. The mass flow W for the orifice for both step 610 and step 620 can be described as a function of the available measurements:

$$W=f(A_e,P_{up},P_{down},T_{up},k,SG),$$

where $A_e$ is the effective area, $P_{up}$ is the local upstream fuel pressure, $P_{down}$ is the local downstream fuel pressure, $T_{up}$ is the local upstream fuel temperature, SG is the specific gravity of the fuel, k is the ratio of specific heats, and g is the gravitational acceleration of the earth. The effective area may represent the known geometry of the mechanical elements and the coefficient of discharge which serves as an empirical correction to match the actual mechanical device to the orifice model.

For step 610, the effective area is that of the fuel control valve 30, the local upstream fuel pressure is the first pressure obtained from first pressure sensor 52, the local downstream fuel pressure is the second pressure obtained from second pressure sensor 53, and the local upstream temperature is the first temperature obtained from first temperature sensor 54. The effective area of the fuel control valve 30 may be a predetermined constant or may be determined by the control system 40.

For step 620, the effective area is the combined effective area of the fuel injector(s) 310, the local upstream fuel pressure is the second pressure obtained from second pressure sensor 53, the local downstream fuel pressure is the fourth pressure 62, and the local upstream temperature is the second temperature 61. The fourth pressure 62 and the second temperature 61 may be determined in one of the manners discussed above, such as by the pressure module 47 and the temperature module 46 respectively.

To determine the first estimate of the specific gravity and the second estimate of the specific gravity the mass flow equation can be rewritten as a function of the known measurements:

$$SG=f(A_e,P_{up},P_{down},T_{up},k,W)$$

The mass flow W for both the first estimate of the specific gravity and the second estimate of the specific gravity may be obtained from flow meter 51. Determining the first estimate and second estimate of the specific gravity may use measurements of mass flow from the mass flow meter 51, measurements of pressure from the first pressure sensor 52 and second pressure sensor 53, and measurements of temperature from the first temperature sensor 54. Other measurements or calculations of mass flow, pressure, and temperature can also be used as previously described herein.

The method further includes determining a third estimate of the specific gravity from the first estimate and the second estimate at step 630. Determining the third estimate of the specific gravity from the first estimate and the second estimate is done by recursively filtering the first estimate and the second estimate, such as by Kalman filtering the first estimate and the second estimate. The recursive filter, such as a Kalman filter, may use a simple linear (time-invariant) model to determine the third estimate of the specific gravity of the fuel from the first and second estimates of the specific gravity of the fuel. The recursive filter may balance a user-specified internal model of how the system evolves over time with the data collected by the sensors in order to produce an improved estimate of the specific gravity of the fuel. The recursive filter may produce an improved estimate of the specific gravity by minimizing the covariance of its estimation errors.

The internal model of the recursive filter may characterize a constant specific gravity being perturbed by normally distributed white noise. The internal model may include a process model and a measurement model. The process model represents what the recursive filter believes will happen to the specific gravity, while the measurement model describes the data captured from the measurements obtained from the sensors. The process model may be defined as a linear time invariant model with process noise. In this embodiment, the process model is first order. However, other orders for the internal process model can be used. The process noise represents the uncertainties and inaccuracies in the process model. The measurement model may be defined as a linear time invariant model with measurement noise. Measurement noise may result from both the first and second estimates. The measurement model may include a first measurement noise for the first estimate and a second measurement noise for the second estimate. The process noise, the first measurement noise, and the second measurement noise can be described by a Gaussian zero-mean sequence to capture uncertain transient behavior of the specific gravity.

The spread of noise may be captured by the covariance of the process noise, the covariance of the first measurement noise and the covariance of the second measurement noise. The covariance of first measurement noise may correspond to the measurements related to the fuel control valve 30 and the covariance of the second measurement noise may correspond to the measurements related to the one or more fuel injectors 310. The covariance of the process noise, the covariance of the first measurement noise, and the covariance of the second measurement noise may be assumed. In some embodiments, the method includes selecting a predetermined value for the covariance of the process noise, the covariance of the first measurement noise, and the covariance of the second measurement noise. In other embodiments, the method includes selecting the covariance of the process noise, the covariance of the first measurement noise, and the covariance of the second measurement noise to tune the recursive filter.

Figure 5:
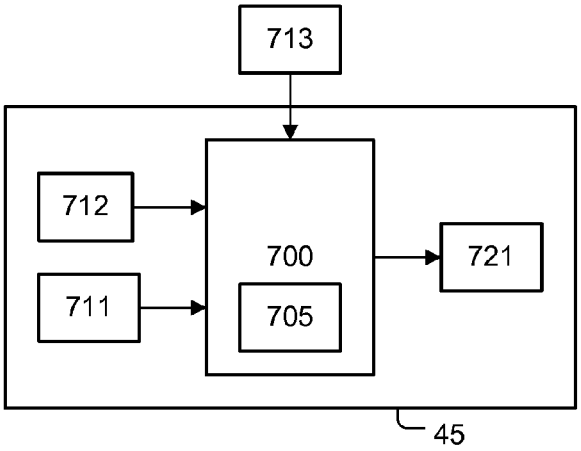
FIG. 5 is a diagram of the recursion of the third estimate of the specific gravity.

FIG. 5 is a diagram of the recursion of the third estimate of the specific gravity. The recursion of the third estimate of the specific gravity may be performed by the specific gravity module 45. As illustrated, the recursive filter 700 receives inputs including measurement inputs 713, previous estimates 711, and covariance inputs 712. The recursive filter uses the inputs with the internal model 705 including the process model and the measurement model to provide current estimates 721. The measurement inputs 713 may include outputs from the various modules and sensors of the fuel system 80, such as the valve module 43, the injector module 44, the temperature module 46, the pressure module 47, the flow sensor 51, the first pressure sensor 52, the second pressure sensor 53, and the first temperature sensor 54.

The previous estimates 711 include the previous specific gravity estimate and the previous error covariance of the specific gravity estimate. When initializing the recursive filter, initial values for the previous specific gravity estimate and the previous error covariance of the specific gravity estimate may be a predetermined value. The predetermined value for each may be selected by an operator.

The covariance inputs 712 are the covariance of the process noise, the covariance of the first measurement noise, and the covariance of the second measurement noise. The covariance inputs 712 may also be predetermined values selected by the operator.

The current estimates 721 include the current specific gravity estimate and the current error covariance of the current specific gravity. The current specific gravity estimate is the third estimate of the specific gravity. The recursive filter 700 determines two gains, such as Kalman gains, from the inputs. The gains may be expressed as:

$$L_F(t) = \frac{\sum_{SG}(t)R_{FM}(t)}{\sum_{SG}(t)((R_F(t) + R_{FM}(t)) - R_F(t)R_{FM}(t)}$$

$$L_{FM}(t) = \frac{\sum_{SG}(t)R_F(t)}{\sum_{SG}(t)((R_F(t) + R_{FM}(t)) - R_F(t)R_{FM}(t)}$$

where $L_F(t)$ is the first gain, $L_{FM}(t)$ is the second gain, $\Sigma_{SG}(t)$ is the previous error covariance of the specific gravity, $R_F(t)$ is the covariance of the first measurement noise, and $R_{FM}(t)$ is the covariance of the second measurement noise.

The recursive filter 700 then uses the two gains to determine the current specific gravity estimate. The current specific gravity estimate can be expressed as:

$$\widehat{SG}(t+1)=(1-L_F(t)-L_{FM}(t))\widehat{SG}(t)+L_F(t)SG_F(t)+L_{FM}(t)SG_{FM}(t)$$

where $\widehat{SG}(t+1)$ is the current specific gravity estimate, $\widehat{SG}(t)$ is the previous specific gravity estimate, $SG_F(t)$ is the first estimate of the specific gravity, and $SG_{FM}(t)$ is the second estimate of the specific gravity.

The recursive filter 700 also uses the two gains to determine the current error covariance of the current estimate of the specific gravity. The current error covariance can be expressed as:

$$\Sigma_{SG}(t+1)=(1-L_F(t)-L_{FM}(t))\Sigma_{SG}(t)+Q(t)$$

Where $\Sigma_{SG}(t+1)$ is the current covariance error of the current estimate of the specific gravity, $\Sigma_{SG}(t)$ is the previous error covariance of the previous estimate of the specific gravity, and $Q(t)$ is the covariance of the process noise.

The method may further include providing the third estimate of the specific gravity to the control module 41 and controlling the gas turbine engine 100 based on the third estimate of the specific gravity. The control module 41 may determine the amount of fuel that needs to be supplied to the one or more fuel injectors 310 and may then send an actuation command signal to the fuel control valve 30 to meter the amount of fuel supplied to the one or more fuel injectors 310.

The method, including each of the method steps, may be performed on a regular predetermined interval while the gas turbine engine 100 is online. The time in the various equations described herein may occur on the regular predetermined interval starting from zero, where (t) is the previous interval and (t+1) is the current interval. In some embodiments, the predetermined interval is set to count each time all sensors have updated and may be the shortest interval of time for each of the sensor measurements to update. In other embodiments, a data hold is used and the data and the predetermined interval is set at a value longer than the shortest interval of time required for each of the sensor measurements to update. The values of the third estimate of the specific gravity and of the error covariance of the third estimate of the specific gravity from a previous determination one interval prior to a current determination are used to determine the third estimate of the specific gravity and the error covariance of the third estimate of the specific gravity for the current determination.

Those of skill will appreciate that the various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the design constraints imposed on the overall system Skilled persons can implement the described functionality in varying ways for each particular application, but such implementation decisions should not be interpreted as causing a departure from the scope of the invention. In addition, the grouping of functions within a module, block, or step is for ease of description. Specific functions or steps can be moved from one module or block without departing from the invention.

The various illustrative logical blocks and modules described in connection with the embodiments disclosed herein can be implemented or performed with a general purpose processor, a digital signal processor (DSP), application specific integrated circuit (ASIC), a field programmable gate array (FPGA) or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

The steps of a method or algorithm described in connection with the embodiments disclosed herein can be embodied directly in hardware, in a software module executed by a processor (e.g., of a computer), or in a combination of the two. A software module can reside in RAM memory, flash memory, ROM memory, EPROM memory, EEPROM memory, registers, hard disk, a removable disk, a CD-ROM, or any other form of storage medium. An exemplary storage medium can be coupled to the processor such that the processor can read information from, and write information to, the storage medium. In the alternative, the storage medium can be integral to the processor. The processor and the storage medium can reside in an ASIC.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular gas turbine engine, it will be appreciated that the online estimation of specific gravity of a gas fuel in accordance with this disclosure can be implemented in various other configurations, can be used with various other types of gas turbine engines, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A method for determining an estimate of the specific gravity of a fuel used in a gas turbine engine including a fuel system that includes a fuel line, a mass flow meter, a fuel control valve located on the fuel line and one or more fuel injectors connected to the fuel line downstream of the fuel control valve, the method comprising:

determining a first estimate of the specific gravity of the fuel using measurements of mass flow from the mass flow meter, a first pressure of the fuel upstream of the fuel control valve, a second pressure of the fuel downstream of the fuel control valve and upstream of the one or more fuel injectors, a first temperature of the fuel upstream of the fuel control valve, and an effective area of the fuel control valve;

determining a second estimate of the specific gravity of the fuel using the measurements of mass flow from the mass flow meter, a third pressure of the fuel upstream of the one or more fuel injectors, a fourth pressure of the fuel downstream of the one or more fuel injectors, a second temperature downstream of the fuel control valve and upstream of the one or more fuel injectors, and a combined effective area of the one or more fuel injectors; and recursively filtering the first estimate of the specific gravity and the second estimate of the specific gravity to determine a third estimate of the specific gravity of the fuel; and providing the third estimate of the specific gravity to a control module of the gas turbine engine and controlling the gas turbine engine based on the third estimate of the specific gravity.

2. The method of claim 1, further comprising:

measuring the first pressure of the fuel from a first pressure sensor on the fuel line upstream of the fuel control valve;

measuring the second pressure of the fuel from a second pressure sensor on the fuel line downstream of the fuel control valve and upstream of the one or more fuel injectors; and measuring the first temperature of the fuel from a first temperature sensor on the fuel line upstream of the fuel control valve.

3. The method of claim 2, further comprising:

determining the third pressure of the fuel based on a correction of the second pressure of the fuel;

determining the fourth pressure of the fuel from a compressor discharge pressure of the fuel, the fourth pressure being a known fraction of the compressor discharge pressure; and determining the second temperature of the fuel from the first pressure and the first temperature using the Joule-Thomson effect.

4. The method of claim 1, wherein recursively filtering the first estimate of the specific gravity and the second estimate of the specific gravity to determine the third estimate of the specific gravity of the fuel includes Kalman filtering the first estimate of the specific gravity and the second estimate of the specific gravity.

5. The method of claim 4, wherein Kalman filtering the first estimate of the specific gravity and the second estimate of the specific gravity uses an internal model that includes a process model and a measurement model.

6. The method of claim 5, wherein a spread of noise in the internal model is captured as a covariance of a process noise of the process model, a covariance of a first measurement noise of the measurement model, and a covariance of a second measurement noise of the measurement model.

7. The method of claim 6, further comprising:

determining a first gain and a second gain based on the covariance of the first measurement noise, the covariance of the second measurement noise, and a previous error covariance of the third estimate of the specific gravity of the fuel; and determining an error covariance of the third estimate of the specific gravity of the fuel based on the first gain, the second gain, and the covariance of the process noise;

wherein recursively filtering the first estimate of the specific gravity and the second estimate of the specific gravity to determine the third estimate of the specific gravity uses the first gain, the second gain, and a previous estimate of the specific gravity of the fuel.

8. The method of claim 7, wherein recursively filtering the first estimate of the specific gravity and the second estimate of the specific gravity to determine the third estimate of the specific gravity and determining the error covariance of the third estimate of the specific gravity are determined on a predetermined interval while the gas turbine engine is online, and wherein values of the third estimate of the specific gravity and of the error covariance of the third estimate of the specific gravity from a previous determination one interval prior to a current determination are used to determine the third estimate of the specific gravity and the error covariance of the third estimate of the specific gravity for the current determination.

9. The method of claim 8, wherein initial values for the previous determination of the third estimate of the specific gravity of the fuel and for the error covariance of the third estimate of the specific gravity are provided by an operator.

10. A method for determining an estimate of the specific gravity of a fuel used in a gas turbine engine including a fuel line including a mass flow meter, a fuel control valve located on the fuel line and one or more fuel injectors connected to the fuel line downstream of the fuel control valve, the method comprising:

determining a first estimate of the specific gravity of the fuel based on an orifice flow model of the fuel control valve modeled as adiabatic compressible flow of an ideal gas through a sharp-edged orifice with a known area and using data collected by sensors connected to the fuel line;

determining a second estimate of the specific gravity of the fuel based on a combined orifice flow model that geometrically describes the one or more fuel injectors by a single effective flow area and using the data collected by the sensors connected to the fuel line; and Kalman filtering the first estimate of the specific gravity and the second estimate of the specific gravity to determine a third estimate of the specific gravity of the fuel using an internal model, the internal model including a process model and a measurement model;

wherein a spread of noise in the internal model is captured as a covariance of a process noise of the process model, a covariance of a first measurement noise of the measurement model, and a covariance of a second measurement noise of the measurement model; and providing the third estimate of the specific gravity to a control module of the gas turbine engine; determining an amount of the fuel to supply to the one or more fuel injectors with the control module; and sending an actuation command signal to the fuel control valve from the control module to meter the amount of the fuel supplied to the one or more fuel injectors.

11. The method of claim 10, wherein the data collected by the sensors includes a first pressure of the fuel, a second pressure of the fuel, and a first temperature of the fuel, the method further comprising:

measuring the first pressure of the fuel from a first pressure sensor on the fuel line upstream of the fuel control valve;

measuring the second pressure of the fuel from a second pressure sensor on the fuel line downstream of the fuel control valve and upstream of the one or more fuel injectors; and measuring the first temperature of the fuel from a first temperature sensor on the fuel line upstream of the fuel control valve.

12. The method of claim 10, further comprising:

determining a first gain and a second gain based on the covariance of the first measurement noise, the covariance of the second measurement noise, and a previous error covariance of the third estimate of the specific gravity of the fuel; and determining an error covariance of the third estimate of the specific gravity of the fuel based on the first gain, the second gain, and the covariance of the process noise;

wherein Kalman filtering the first estimate of the specific gravity and the second estimate of the specific gravity to determine the third estimate of the specific gravity uses the first gain, the second gain, and a previous estimate of the specific gravity of the fuel.

13. The method of claim 12, wherein Kalman filtering the first estimate of the specific gravity and the second estimate of the specific gravity to determine the third estimate of the specific gravity and determining the error covariance of the third estimate of the specific gravity are performed on a predetermined interval while the gas turbine engine is online, and wherein values of the third estimate of the specific gravity and of the error covariance of the third estimate of the specific gravity from a previous determination one interval prior to a current determination are used to determine the third estimate of the specific gravity and the error covariance of the third estimate of the specific gravity for the current determination.

14. The method of claim 13, wherein initial values for the previous determination of the third estimate of the specific gravity of the fuel and for the error covariance of the third estimate of the specific gravity are predetermined and provided prior to initializing the method.

15. A fuel system for a gas turbine engine including one or more fuel injectors and a fuel line that supplies fuel to the one or more fuel injectors, the fuel system comprising: a fuel control valve on the fuel line upstream of the one or more fuel injectors; a mass flow meter in the fuel line; a computer controller comprising: an estimation module including a valve module configured to determine a first estimate of the specific gravity of the fuel using measurements of mass flow from the mass flow meter, a first pressure of the fuel upstream of the fuel control valve, a second pressure of the fuel downstream of the fuel control valve and upstream of the one or more fuel injectors, a first temperature of the fuel upstream of the fuel control valve, and an effective area of the fuel control valve, an injector module configured to determine a second estimate of the specific gravity of the fuel using the measurements of mass flow from the mass flow meter, a third pressure of the fuel upstream of the one or more fuel injectors, a fourth pressure of the fuel downstream of the one or more fuel injectors, a second temperature downstream of the fuel control valve and upstream of the one or more fuel injectors, and a combined effective area of the one or more fuel injectors, and a specific gravity module configured to determine a third estimate of the specific gravity of the fuel from the first estimate of the specific gravity and the second estimate of the specific gravity with a recursive filter and a control module configured to receive the third estimate of the specific gravity from the specific gravity module, determine an amount of the fuel to supply to the one or more fuel injectors, and send an actuation command signal to the fuel control valve to meter the amount of fuel supplied to the one or more fuel infectors.

16. The fuel system of claim 15, further comprising:

a first pressure sensor on the fuel line upstream of the fuel control valve for measuring the first pressure of the fuel;

a second pressure sensor on the fuel line downstream of the fuel control valve and upstream of the one or more fuel injectors for measuring the second pressure of the fuel; and a first temperature sensor on the fuel line upstream of the fuel control valve for measuring the first temperature of the fuel.

17. The fuel system of claim 16, wherein the estimation module also includes:

a pressure module configured to determine the third pressure of the fuel from the second pressure of the fuel and the fourth pressure of the fuel from a compressor discharge pressure of the fuel, the fourth pressure being a known fraction of the compressor discharge pressure; and a temperature module configured to determine the second temperature of the fuel from the first pressure and the first temperature using the Joule-Thomson effect.

* * * * *